United States Patent [19]

Erhard

[11] Patent Number: 5,046,468

[45] Date of Patent: Sep. 10, 1991

[54] METHOD AND SYSTEM WITH INDUCTIVE ROTARY EMITTER FOR THE CONTROL ESPECIALLY OF THE IGNITION TIMING OF INTERNAL COMBUSTION ENGINES

[75] Inventor: Werner Erhard, Cadolzburg, Fed. Rep. of Germany

[73] Assignee: Prüfrex-Elektro-Apparatebau Inh. Helga Müller, geb./Dutschke, Cadolzburg, Fed. Rep. of Germany

[21] Appl. No.: 558,736

[22] Filed: Jul. 27, 1990

[30] Foreign Application Priority Data

Jul. 27, 1989 [DE] Fed. Rep. of Germany ..... 3924843

[51] Int. Cl.[5] ..... F02P 5/145; F02P 5/15; F02P 9/00; F02P 3/08

[52] U.S. Cl. ..... 123/414; 123/600

[58] Field of Search ..... 123/414, 476, 612, 599, 123/600, 602, 605, 617, 418

[56] References Cited

U.S. PATENT DOCUMENTS

| | | | |
|---|---|---|---|
| 4,553,426 | 11/1985 | Capurka | 123/414 X |
| 4,610,237 | 9/1986 | Ionescu et al. | 123/600 |
| 4,697,570 | 10/1987 | Ionescu et al. | 123/600 X |
| 4,796,208 | 1/1989 | Kumagai et al. | 123/414 X |
| 4,797,827 | 1/1989 | Cockerham | 123/414 X |
| 4,870,587 | 9/1989 | Kumagai | 123/414 X |

FOREIGN PATENT DOCUMENTS

| | | | |
|---|---|---|---|
| 2833223 | 2/1979 | Fed. Rep. of Germany | 123/600 |
| 1319022 | 1/1963 | France | 123/617 |

*Primary Examiner*—Willis R. Wolfe

*Attorney, Agent, or Firm*—Jordan and Hamburg

[57] ABSTRACT

Inductive rotary emitter for controlling the instant of ignition of internal combustion engines, has a coil with a permanent magnet core and a yoke wheel turned by a shaft. Circumferentially distributed projecting, spaced, tooth-like segments on the yoke wheel are moved past the magnet poles for voltage induction. Tangentially adjacent tooth segments are at differently spaced intervals from one another.

18 Claims, 3 Drawing Sheets

METHOD AND SYSTEM WITH INDUCTIVE ROTARY EMITTER FOR THE CONTROL ESPECIALLY OF THE IGNITION TIMING OF INTERNAL COMBUSTION ENGINES

BACKGROUND OF THE INVENTION

The invention relates to an inductive rotary emitter for the control, especially of the ignition timing, of internal combustion engines, having a coil with a permanent-magnetic core and a yoke wheel rotated by a shaft and bearing tooth-like segments projecting from and distributed about its circumference and moving past the magnetic poles for the induction of voltage. The invention furthermore relates to a method for the ignition of internal combustion engines, especially in lawn mowers, power saws and cut-off grinders, in which such a rotary emitter is used. The invention lastly relates to a condenser ignition system having a rotary emitter of said kind.

In known condenser ignition systems the operation of the electronic switch is produced either by an external igition pulse emitter or by an internal ignition pulse emitter which, for example, produces the necessary ignition signal from the charge in the condenser through a voltage divider. It is common to control the ignition timing according to the operating state of the internal combustion engine, especially according to its rotatory speed. The use of the above-mentioned segment wheels coupled to the crankshaft of a gasoline engine is known for this purpose; these wheels are yoke wheels formed from high-permeability, ferromagnetic material from whose circumference uniformly distributed tooth-like segments project radially or axially. The segments cooperate with the pole shoes of a permanent magnet which is surrounded by a coil. As soon as the yoke wheel rotates, an alternating current is induced in the coil on account of the variation of the air gap between the pole shoes and the yoke wheel and hence of the magnetic flux passing through the coils. To trigger a spark, an additional magnetic rod or the like must be provided in the case of the known yoke wheels in order to inform the unit that fires the spark of the angular postion of the yoke wheel.

SUMMARY OF THE INVENTION

It is therefore an object of the invention to configure, without additional triggering means such as a magnetic rod or the like, a condenser ignition system, and especially an inductive rotary emitter for same, such that, by a simple design, of high reliability and inexpensive manufacture, it will be possible to determine the moment of ignition in accordance with a defined absolute rotatory position in the internal combustion engine.

Pursuant to the invention, this objective is accomplished in an inductive rotary emitter of the kind described above, by providing the adjacent tooth-like segments with different tangential spacing. Since the arrangement of these separations of different width around the circumference of the yoke wheel can be programmed into the spark firing electronics, it is therefore possible for the latter to recognize electronically the absolute rotational angle of the internal combustion engine, and on that basis to establish the optimum moment for the firing of the spark, especially in the critical starting and running phase. For this purpose one practical embodiment of the invention consists in providing only two different intervals, one of which, preferably the greater interval, applies only to two adjacent segments. The section of the circumference defined by these two segments differs definitely from the other section and consequently it can be recognized through the inductive signal emitted by the processing circuit connected to the output and can be used as a point of reference.

To facilitate the derivation of this point of reference from the rotary emitter signals, and especially to save hardware and/or computer expense, it is advantageous according to a further development of the invention to provide two separate coils, each associated with one pole of the permanent magnet field passing through the coils. Also, the further processing by the processing circuit of the signals output by the coils can be facilitated if the distance between the coils and/or magnet poles corresponds to the interval relating to more than only two segments, i.e., to the shorter, lesser interval. As a result, the voltages induced in the coils have an approximately constant phase shift from one another, i.e., the half-waves overlap one another in phase.

The manufacture of the yoke wheel is facilitated if, in the case of two different intervals (see above), the wider or greater interval amounts to twice the smaller interval. Thus, in forming the tooth segments over the circumference of the yoke wheel the smaller interval can be taken as the standard interval, and only one segment is omitted in order to achieve the wider or greater interval (forming a gap).

It is obvious that it would be desirable to provide more than two tooth segments, or at least three tooth segments. In the scope of further developments of the invention, nine segments can be provided, for example, with a tangential spacing between them corresponding to an angle of 36°, omitting one segment in accordance with the above idea; as a result, between two of the segments alone there would be a wider separation corresponding to an angle of 72°.

Using the rotary emitter in accordance with the invention with a single wider separation, a process for the ignition of internal combustion engines, especially in lawn mowers, chain saws or cut-off grinders, can be advantageously developed as follows: an ignition timing system derives spark pulses from the rotary emitter and with them, in connection with programmed operating characteristics, it controls in a retarded or advanced manner a circuit which discharges a condenser through the primary winding of an ignition coil; the production of the spark takes place in the starting phase below an engine speed limit depending on the angular position of the gap formed in the yoke wheel by the wider spaced tooth segments. This can assure that the ignition will always take place at the optimum moment regarding the (top) dead center of the engine, because by means of the marking on the circumference of the yoke wheel in accordance with the invention, the spark timing can always start out from the absolute angular position. Thus it is possible that, in the starting speed range, independently of fluctuations in the rotatory speed or variations in the angular velocity, the ignition will always take place at a specific position of the segment wheel, and that after reaching a specific rotatory speed the spark will be controlled in accordance with the rotatory speed.

It is conceivable especially, in further development of the invention, to cause the firing of the spark in the starting phase to take place while or after one of the tooth segments following the gap moves past the pole of the permanent magnet. In practice, the third tooth segment has proven to be best for triggering ignition derived from the absolute rotatory position of the yoke wheel.

Often it is desirable that the triggering of the spark by the third tooth segment or the pulse derived therefrom take place only when the rotatory speed of the motor is above a programmed threshold while the second and third tooth segment after the gap is passing the magnet poles or pole shoes. For this purpose, a further development of the method of the invention consists in making the spark dependent upon the measurement of the angular velocity by means of two adjacent tooth segments in the starting phase.

In further development of this idea, for the concrete embodiment of the method of the invention, the following sequence is provided: in the starting phase the angular velocity is measured by means of the time elapsing between the passage of the second and then the third tooth segment after the gap, and not until the measurement exceeds a certain threshold is the spark fired as the third tooth segment moves past the pole shoe. Beginning at a speed of about 1500 rpm, according to this concrete procedure, the angular velocity is measured in the interval formed by the first and second tooth segments. At the same time the spark triggering is performed in the range between the second and the third tooth segment gap. Thus an advance of the spark becomes possible. At rotatory speeds above 5,000 rpm, the spark advance is increased such that, before the second segment has completed its movement past a (sensed) magnet pole the spark can be fired. This extreme advance is possible because in this speed range the speed fluctuations are slight.

By using the emitter according to the invention, with only one additional interval involving only two tooth segments and two separate coils disposed one on each magnet pole, condenser spark systems, known in themselves, can be advantageously improved so that especially the above explained process can be performed.

Thus, voltage half-waves induced in the two separate coils, each with the same polarity, are picked up and fed to a condenser connected to an ignition coil, in order to charge it. By means of a discharging switch coupled to the condenser, which is best controlled by the above-described spark timing control, the condenser can then be discharged at the desired moment on the basis of a programmed family of ignition curves. The voltage waves induced in the two coils, of different, opposite polarity, are each fed to a pulse former whose outputs are fed to a pulse processing section which produces one single pulse (per revolution) from the input pulses upon each complete yoke wheel rotation; this corresponds to an absolute angular rotatory position of the yoke wheel. The pulse processing circuit can be designed, for example, so that the individual pulse will always occur when the top dead center of the internal combustion engine is reached. In any case, this single pulse can serve as an absolute point of reference, on the basis of which the moment of ignition can be specified by the control electronics according to the state of the engine and the programmed operating characteristics.

It is within the scope of the invention that the pulse processing circuit can be a microcomputer circuit with appropriate software, or a hard-wired digital system. An especially advantageous, uncomplicated variant, the pulse processing circuit has at the input end a static memory controlled by the engine condition, and at the output end a dynamic memory controlled by the cycle flank. The memories are best in the form of flip-flops. They are arranged in cascade or series with one another; the input pulse signal based on one of the two coils serves for the takeover control of the dynamic memory on the output end and for resetting both of the memories. The input pulse signal derived from the other coil is used for setting the static memory at the input end. This circuit variant is geared mainly to the above-mentioned configuration of the rotary emitter, in which the distance between the coils and/or magnet poles corresponds to the smaller (control) separation relating to more than only two tooth segments. Then the half-waves derived from the separate coils and the pulses formed thereon by means of the Schmitt trigger circuit overlap one another. When the gap on the circumference of the yoke wheel encounters one of the magnet poles, only one pulse is produced by one of the two coils and serves to set the input-end memory in a definite state. When immediately thereafter only one pulse from the other coil occurs, the corresponding pulse can cause the output-end memory to take over the output of the input-end memory. When the next two tooth segments then move simultaneously past two of the magnet poles, again a pulse is produced simultaneously in each coil, and the memories are reset.

In a further improvement of the ignition system, the single pulse is fed to a total time counter for one complete revolution, and the output signal of the total time counter influences a pulse and retarding generator connected with programmed ignition characteristics, its output pulses then serve to operate the discharge switch and thus to the discharge of the condenser. Especially if the engine is no longer in the starting phase, a desired, speed-related advance of the moment of ignition can be achieved if the ignition characteristics are coded accordingly. A switching means formed by hardware or software, which operates in accordance with the starting phase and the normal phase of running under load, enables the device to operate on branches or curves within the operating characteristic, depending on the state of the switch.

In the starting phase of the engine, to prevent ignition at too low a momentary speed, provision is advantageously made, as a further development of the invention, for inserting an additional circuit between the generator output and the discharge switch; this circuit is controlled by a momentary time counter for rotatory speed measurement, which senses the time sequence of two adjacent tooth segments running past the magnet poles. The control itself is performed in relation to one or more preprogrammed threshold values which correspond to given minimum rotatory speeds.

BRIEF DESCRIPTION OF THE DRAWINGS

Additional features, details and advantages of the invention will be found in the following description of an embodiment of the invention, with the aid of the drawing, wherein.

DESCRIPTION OF THE PREFERRED EMBODIMENTS

Figure 1:
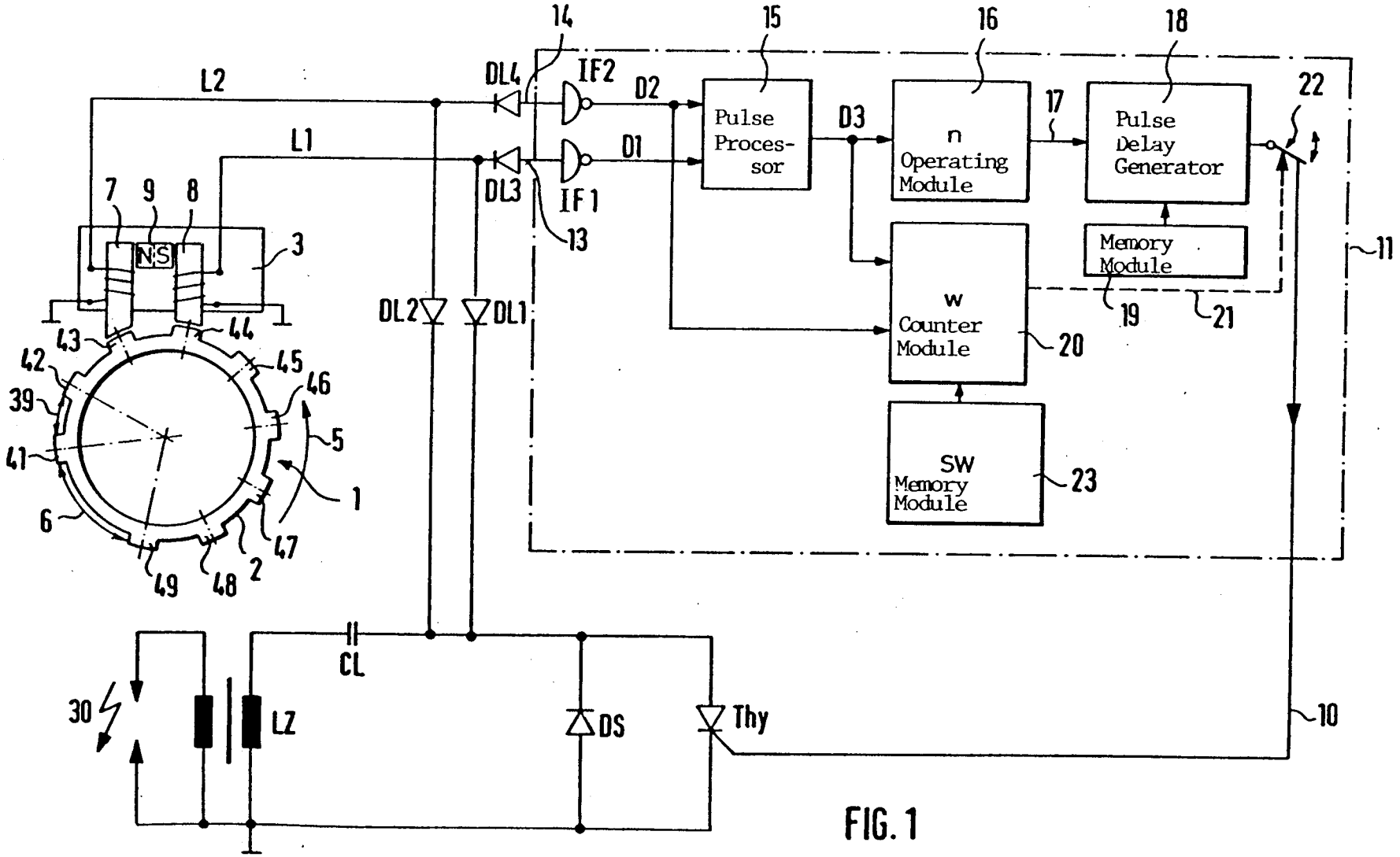
FIG. 1 is a schematic diagram of the arrangement of the apparatus and of the operation of a condenser ignition system in accordance with the invention.

As presented in FIG. 1, the rotary emitter 1 in accordance with the invention consists of a yoke wheel 2 and an ignition module 3. The yoke wheel 2 is coupled for rotation with a shaft (not shown) of an internal combustion engine, and has tooth segments 41 to 49 distributed around its circumference and, in the illustrated example, projecting radially. The tooth segments are at a regular tangential distance apart from one another corresponding to an angle of 36°, which if the circumference of the yoke wheel were fully occupied, would give a total of ten tooth segments. However, in accordance with the invention, at about the lower left quadrant in the drawing, a larger tooth segment gap 6 is formed, corresponding to an angular separation of 72°, since in the regular placement of the tooth segments the tenth was omitted. When the yoke wheel 2 rotates in sense 5, the tooth segments 41 to 49 are moved successively past two pole shoes 7 and 8. Through these pole shoes passes the field of a permanent magnet 9, and around them is wound a first coil L1 and a second coil L2. In the rotation of the yoke wheel 2, which serves to produce a magnetic reaction, the air gaps between the yoke wheel 2 and the pole shoes 7 and 8 are alternately increased and reduced, which produces a change in the magnetic flux through the two coils L1 and L2. This induces a voltage at the coil which corresponds approximately to the signal patterns a and b over the time t in FIG. 3. Accordingly, positive and negative half waves from each coil overlap one another, which is caused by the fact that the separation of pole shoes 7 and 8 from one another corresponds approximately to the (shorter) spacing of the tooth segments 41 to 49, with the exception of the tooth segments 41 and 49 defining the longer gap 6.

By means of rectifier diodes DL1 and DL2 the positive half waves derived from coils L1 and L2 are fed to the condenser Cl to charge it. Connected in parallel with a free-running diode DS is a discharge switch Thy, a thyristor in the illustrated embodiment, which is triggered by the output 10 from the ignition timing unit 11.

The ignition timing unit 11 can be a microcomputer or a custom-made integrated circuit. It has inputs 13 and 14 associated with one of the two coils L1 and L2, respectively, to whose input a rectifier diode DL3 and DL4, respectively, is so connected that only the negative half-waves induced in the two coils L1 and L2 are passed through. To each of the two rectifier diodes DL3, DL4, there is connected an inverting pulse former IF1, IF2, which produces from the half-waves pulses which can be digitally processed. Inverting Schmitt triggers (cf. FIG. 2) can be used, for example, for this purpose. The negative half-waves thereby formed into positive pulses D1, D2, from the coils L1, L2, are then fed to a pulse processor 15 which uses them to generate a single pulse for each complete revolution of the yoke wheel 2. This pulse, on the basis of the configuration of the pulse processor 15 in accordance with the invention, corresponds to a certain absolute angular position of the yoke wheel 2, at which the gap 6 is still opposite the pole shoe through which the north pole magnetic field passes.

The single pulse D3 is first fed to an operating module 16 serving for the measurement of the rotatory speed n during one complete rotation; its output 17 affects a pulse delay generator 18. This operating module 18 is additionally connected functionally to a memory module 19 which has operating characteristics containing, for example, the engine speed n as a parameter. Under the influence of the speed measuring module 16 and of the operating characteristics module 19 the pulse delaying module 18 produces in some cases advanced controlling signals which are fed to the thyristor Thy, whereupon the latter fires and discharges the condenser through the ignition coil LZ.

Furthermore, the ignition timing control 11 includes a counter module 20 which determines the momentary rotatory speed or angular velocity with the aid of two adjacent tooth segments 41 to 49, and which connects the output 10 of the ignition timing control 11 or of the pulse retarding module 18 to the thyristor Thy, depending on the momentary angular velocity W, by accordingly actuating with its output 21 (drawn in broken lines) a switch 22. As seen in FIG. 1, the counter module 20 additionally processes the single pulse D3 at the output of the pulse processor module 15 and communicates with an additional memory module 23 which contains thresholds SW corresponding to minimum angular velocities.

Figure 2:
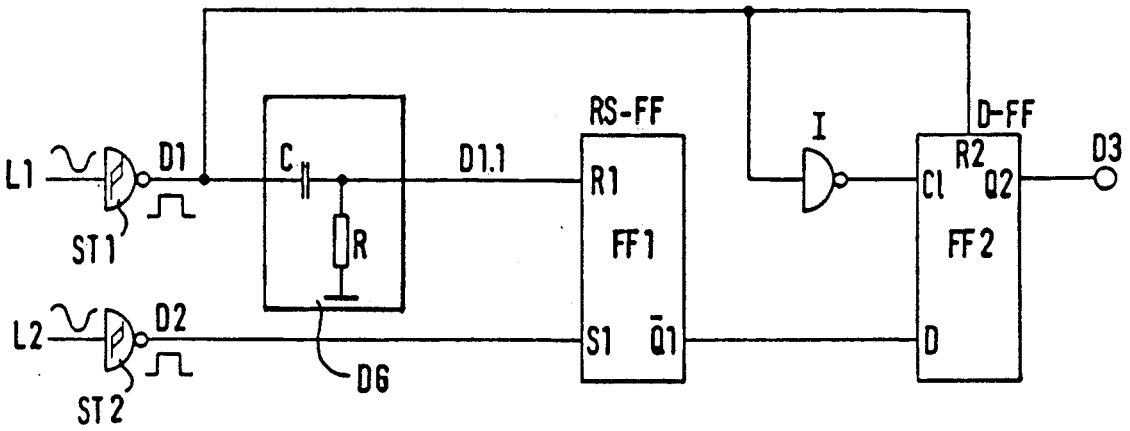
FIG. 2 is a block circuit diagram of the pulse processor, FIGS. 3 *a–g* are pulse-time diagrams relating to the pulse processor.
Figure 3:
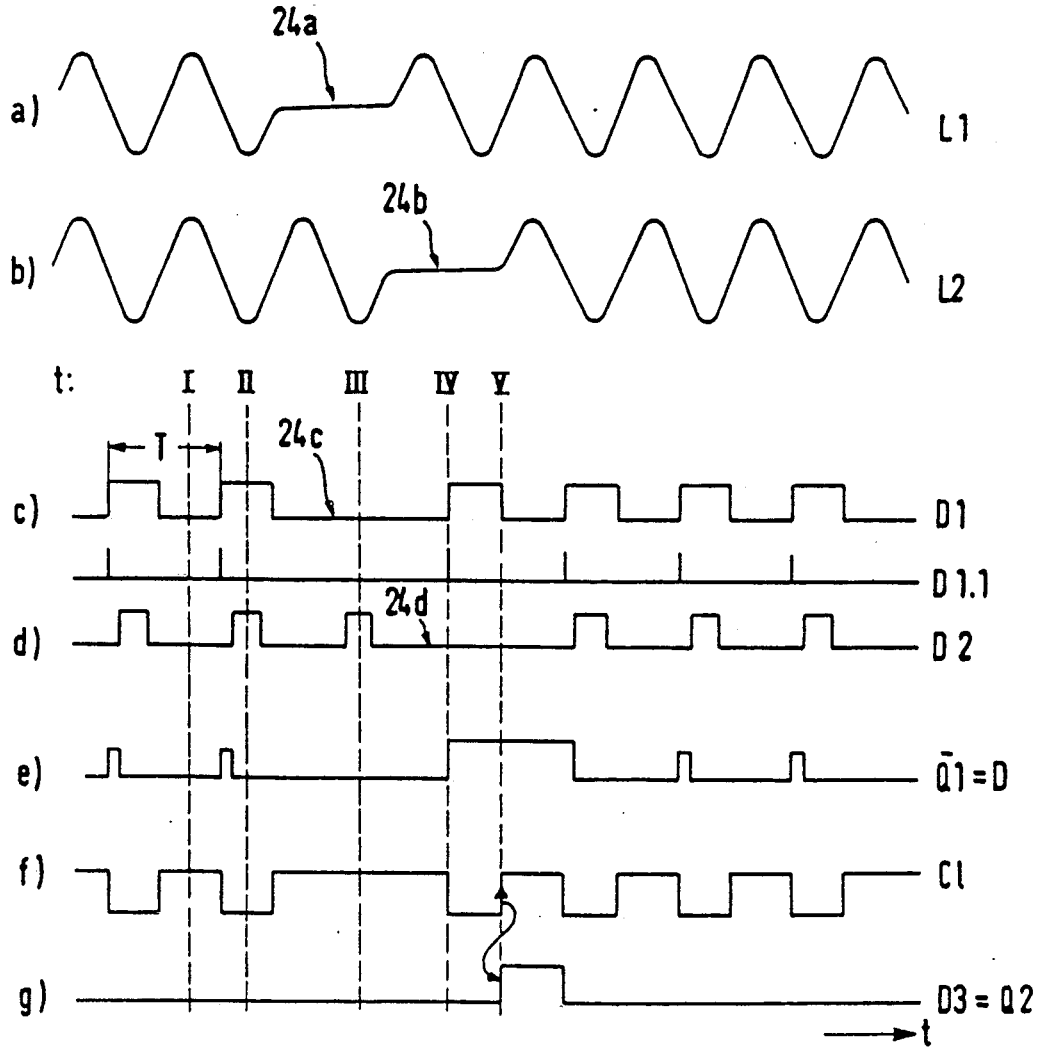

FIG. 2 represents the production of the pulse processing module 15 as a hard-wired switching logic: the negative half-waves taken from the two coils L1, L2, are each fed to a Schmitt trigger ST1, ST2, which produces inverted positive pulses D1 and D2 (cf. signal patterns c) and d) in FIG. 3). The pulse series D1 derived in accordance with FIG. 1 from the south pole magnetic field is fed to the reset input R1, and the pulse series D2 derived from the other coil L2 with the oppositely polarized magnetic field is fed to the set input S1 of 9 known Rs flip-flop FF1. Preferably an RC high-pass filter DG, which consists of the condenser C and the grounded resistance R, is directly connected to the reset input R1. The complementary output Q1 of the RS flip-flop FF1 is directly connected to the data input D of a known D-flip-flop FF2 which is connected in cascade or series. The reset input R2 of the D-flip-flop FF2 is connected directly, and its cycling input CL responding to positive flanks is connected indirectly through an inverting gate I to the output of the first Schmitt trigger ST1 which forms into impulses the negative half-waves of the coil L1 through which the magnetic south pole passes. The output signal of the entire switch system in accordance with FIG. 2 is formed by the noninverting output Q2 of the D-flip-flop FF2, at which a single impulse is available for each revolution of the yoke wheel 2 (cf. FIG. 1), as it will be explained below.

In FIG. 3 are seen signal patterns a) to g) over the time t. The signal patterns a) and b) reflect the voltages induced in the coils L1 and L2, the rectilinear, non-sloping sections 24*a*, 24*b*, developing on the basis of the tooth segment gap 6 in the yoke wheel 2 (cf. FIG. 1). From these induced vibrations are derived the signal patterns c) of the first pulse series D1 derived from the first coil L1, and d) of the second pulse series D2 derived from the second coil L2, and their longer, pulse-free sections 24*c*, 24*d*, correspond to the above-mentioned rectilinear sections 24*a*, 24*b*. During the time period I the RS-flip-flop FF1 is set and the D-flip-flop FF2 is reset. Every rising, positive flank of the first pulse series D1 sets the cycling input C1 of the D-flip-flop FF2 to logical "0." The differentiating circuit DG produces from the first pulse series D1 corresponding, needle-like short pulses D1.1, whose length through the size of the RC high-pass filter is such that the RS-flip-flop FF1 is safely reset. The inverting output Q1 of RS-flip-flop FF1 is then at logical "1."

The next-following, rising positive flank of the second pulse series D2 sets the RS-flip-flop FF1, which accordingly is set at moment II. The descending flank of the second pulse series D2 that next follows produces a rising flank or positive pulse for the cycling input C1 of the D-flip-flop FF2 on the basis of the interposed inverter I. This triggers the transfer of the level at the data input D of the data flip-flop FF2 to its (non-inverting) output Q2. If the data input D was previously at logical "0," the output Q2 of the data flip-flop FF2 does not change. The next pulse of the second pulse series D2 at moment III has no effect. The RS flip-flop FF1 was previously set and remains set.

At moment IV the RS flip-flop FF1 was reset by the pulse series D1.1 produced through the differentiating circuit DG. Since now the setting pulse based on the second pulse series D2 is lacking, the data input D of the data flip-flop is at logical "1." With the next descending flank of the pulse series D1 (cf. moment V), a data transfer to input D is triggered by the inverter I at the cycling input Cl of the data flip-flop FF2, and hence the data flip-flop FF2 is set. This makes the output level logical "1" at the output Q2, which forms the single pulse D3 for each rotation of the yoke wheel 2 (cf. g) in FIG. 3).

It can be deduced from this that the single pulse D3 per revolution is formed essentially by the pulse gap 24*d* of the second pulse series D2, which in this example is based on the second coil L2 in which the magnetic north pole field prevails. Therefore it is still within the scope of modifications in accordance with the invention to cause the gap 6 in the yoke wheel 2, or its pulse-free section (pulse gap) 24*d* of the second pulse series D2, to be recognized and sensed with only one single coil.

Figure 4:
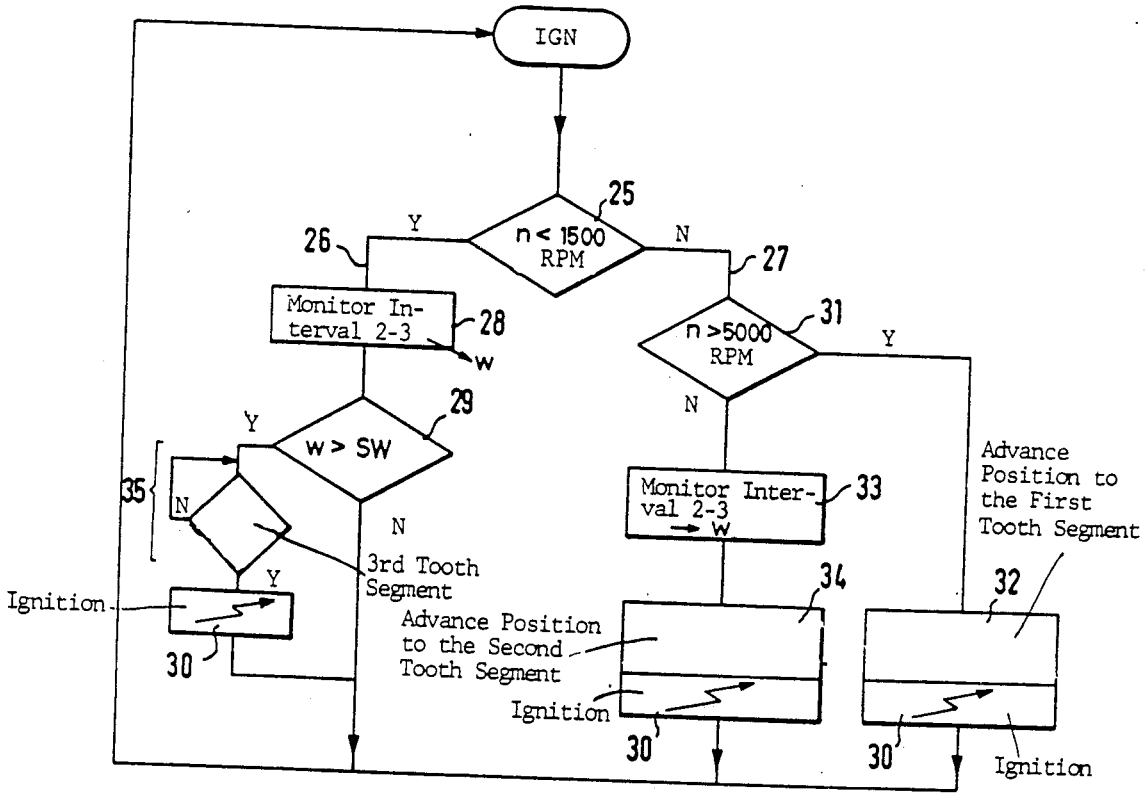
FIG. 4 is a flow diagram relating to an embodiment of the method of the invention.

To conclude, a possibility for the practice of the process of the invention is set forth in the flow diagram of FIG. 4: the functional module 16 measuring the rotatory speed n for one full rotation of the yoke wheel 2 performs a branching off according to the rotatory speed: if the speed is less than 1500 rpm, path 26 is taken; otherwise, path 27. In path 26 a momentary rotatory speed detection is provided, e.g., between the second and the third tooth segment (cf. reference numbers 42 and 43 in FIG. 1), after the tooth segment gap 6 in the yoke wheel 2, which is performed by the counter module determining the momentary angular velocity w with the aid of the second pulse signal D2 (cf. function block 28 in FIG. 4). Then a query 29 is made whether the momentary angular velocity w exceeds certain threshold levels SW stored in the memory module 23 in FIG. 1 corresponding to pre-programmed minimum rotatory speeds. If so, a return is made to the starting point of the process or program after ignition 30 has occurred strictly with the third segment 43 (cf. wait loop 35), or otherwise without ignition.

If on the basis of a NO decision the program branch 25 is carried into path 27 because the rotatory speed determined over a full revolution of the yoke wheel 2 exceeds 1500 rpm, a query 31 is made whether the resultant speed n exceeds 5000 rpm. If so, the ignition is admitted into the interval formed by the first and second tooth segment after the gap (cf. tooth segments 41 and 42 in FIG. 1) in accordance with block 32 followed by ignition block 30. The ignition can, however, also be triggered in accordance with the registered operating characteristic within the interval defined by the second and third tooth segments 42 and 43. If the rotatory speed n corresponding to one complete revolution is less than 5000 rpm, the momentary angular velocity w is determined or monitored in the interval defined by the first and second tooth segment 41, 42, after the gap 6—cf. block 33. Thus, within the interval defined by the second and third tooth segments 42 and 43, the ignition can be advanced as far as the second tooth segment 42—cf. block 34. The spark advance 32, 34, is performed as specified by the operating characteristic BKF stored in the memory module 19 (FIG. 1).

What is claimed is:

1. In a control system including an inductive rotary emitter for controlling the instant of ignition of an internal combustion engine, comprising a permanent magnet core and a rotatable yoke wheel, said yoke wheel having a plurality of circumferentially spaced projecting tooth-like segments distributed about its circumference, said yoke wheel being adapted to be moved past said core for the induction of voltages in a coil on said core, whereby a first pulse is generated in response to each passage of a segment past said core, a first pair of adjacent said segments being spaced by a first distance, and at least two adjacent ones of said segments being spaced by a second distance different from said first distance, and means responsive to said first pulses for generating ignition pulses, the improvement wherein said system further comprises means for determining the speed of said engine, said means for generating ignition pulses comprising means for generating ignition pulses in response to first pulses responsive to the passage of a first segment past said yoke when the speed of the engine is below a predetermined value, and means for generating ignition pulses in response to first pulses responsive to the passage of a second segment past said yoke when the speed of the engine is above said predetermined value.

2. The control system of claim 1 wherein said first distance is greater than said second distance.

3. The control system of claim 1 wherein said permanent magnet core has first and second coils thereon, each corresponding to a separate magnetic pole.

4. The control system of claim 2 wherein the spacing between said magnetic poles corresponds to said second distance.

5. The control system of claim 1 wherein said first distance is twice as great as said second distance.

6. The control system of claim 1 wherein said yoke wheel has more than two of said segments.

7. The control system of claim 1 wherein said yoke wheel has nine of said segments, two adjacent segments being positioned at an angle of 72° with respect to one another, and the remainder of the adjacent segments being positioned at an angle of 36° with respect to one another.

8. In the method for the ignition of an internal combustion engine comprising controlling the time of actuation of a switching means for initiating the discharge of a capacitor through the primary winding of an ignition coil, the improvement comprising deriving a train of ignition pulses that have a first spacing between a first pair of adjacent pulses and a second spacing between a pair of adjacent pulses, during a rotation cycle of said engine, said first and second spacings being different, and actuating said switching means, at starting speeds of said engine below a predetermined speed, in response to occurrence of said first spacing between said first pair of adjacent pulses.

9. The method of claim 8 wherein said step of actuating said switching means at starting speeds comprises actuating said switching means independently of variations in rotary speed of said engine below said predetermined speed, whereby the actuation of said switching means at said starting speeds always occurs at a predetermined time with respect to said first spacing, and further comprising actuating said switching means as a function of said speed at engine speeds above said predetermined speed.

10. The method of claim 9 wherein said step of deriving a train of pulses comprises rotating a yoke wheel past a fixed permanent magnet, the yoke wheel having teeth with first and second different spacings therebetween, to induce voltage pulses in at least one coil, said step of actuating said switching means at starting speeds comprising actuating said starting means as or after a predetermined tooth passes said permanent magnet following the passage thereby of said first spacing.

11. The method of claim 10 wherein said step of actuating at starting speeds comprises actuating said switching means as or after the third tooth following said first spacing passes said permanent magnet.

12. The method of claim 10 further comprising determining the speed of said engine by determining the time between the passage of first and second teeth of said yoke wheel past said permanent magnet.

13. The method of claim 12 wherein said step of determining comprises detecting the angular velocity of said yoke wheel in a starting phase as the second and third teeth following said first space passes said permanent magnet, actuating said switching means during said starting phase at the time said third tooth passes said permanent magnet when said angular velocity exceeds a predetermined threshold value, detecting the angular velocity of said yoke wheel in an operating phase, at speeds above at least 1500 rpm, as the first and second teeth following said first space passes said permanent magnet, actuating said switching means during said operating phase at speeds below 5000 rpm, after the second tooth and before the fourth tooth, following said first spacing, has passed said permanent, and actuating said switching means during said operating phase at speed above 500 rpm, before said second tooth has moved past said permanent magnet.

14. In a condensor ignition system having a source of first and second trains of pulses synchronized with the rotation of an engine, the pulses of each train having a first spacing between first and second pulses during each said rotation that corresponds to a respective angular displacement of said engine, and a smaller second smaller spacing between the remainder of the pulses of the respective pulse train, and discharge switch means connected to discharge a capacitor through a spark coil, the improvement wherein said system comprises means for charging said capacitor with half waves of like polarity derived from said first and second pulse trains, pulse forming means for deriving pulses from half waves of opposite polarity derived from said first and second pulse trains, and a pulse processing means responsive to the outputs of said pulse forming means for producing an output pulse that occurs at an absolute angular displacement of said engine.

15. The condensor ignition system of claim 14 wherein said pulse processing means comprises cascade connected state-controlled memory means and a cycle-flank-controlled memory element, means responsive to the output of said first pulse forming means for controlling take-over actuation of said cycle-flank-controlled memory element, and means responsive to the output of said second pulse forming means for setting said state-controlled memory element.

16. The condensor ignition system of claim 15 further comprising a total time timer, means applying said output pulse from said pulse processing means to said total time timer, a pulse-and-delay generator including memory means storing programmed sets of spark parameters, means applying the output of said total time timer to said pulse-and-delay generator, and means for connecting the output of said pulse-and-delay generator to actuate said switching means.

17. The condensor ignition system of claim 16 wherein said means for connecting the output of said pulse-and-delay generator to actuate said switching means comprises a switching arrangement, and further comprises a pulse counter responsive to the output of one of said pulse forming means for determining the angular velocity of said engine, said pulse counter being connected to control said switching arrangement in response to determined pulses of the respective pulse train, for actuating said switching means in accordance with threshold values corresponding to predetermined minimum angular velocities of said engine.

18. In a control system using an inductive rotary emitter for controlling the instant of ignition of an internal combustion engine, comprising a rotatable yoke wheel having a plurality of circumferentially spaced projecting tooth-like segments distributed about its circumference, said yoke wheel being mounted to be moved past a coil for the induction of first pulses therein, a first pair of adjacent said segments being spaced by a first distance, and at least two adjacent ones of said segments being spaced by a second distance different from said first distance, means for determining the speed of said engine, and means responsive to said first pulses for generating ignition pulses, the improvement wherein said means for generating ignition pulses comprises means for generating said ignition pulses in response to first pulses responsive to the passage of different segments past said coil, as a function of the speed of the engine.

* * * * *